US007367268B2

(12) United States Patent
Westphal et al.

(10) Patent No.: US 7,367,268 B2
(45) Date of Patent: May 6, 2008

(54) SAFETY AND ARMING DEVICE FOR A SPINNING PROJECTILE FUZE

(75) Inventors: Günter Westphal, Hardt (DE); Frank Kienzler, VS=Villingen (DE); Herbert Höni, Aichhalden-Röthenberg (DE)

(73) Assignee: Junghans Microtec GmbH, Dunningen-Seedorf (DE)

( * ) Notice: Subject to any disclaimer, the term of this patent is extended or adjusted under 35 U.S.C. 154(b) by 247 days.

(21) Appl. No.: 11/321,304

(22) Filed: Dec. 29, 2005

(65) Prior Publication Data

US 2006/0260499 A1 Nov. 23, 2006

(30) Foreign Application Priority Data

Jan. 28, 2005 (DE) ..... 10 2005 003 942

(51) Int. Cl.
*F42C 15/34* (2006.01)

(52) U.S. Cl. ..... 102/251; 102/235; 102/244; 102/256

(58) Field of Classification Search ..... 102/233, 102/235, 236, 244, 251, 256
See application file for complete search history.

(56) References Cited

U.S. PATENT DOCUMENTS 3,326,132 A 6/1967 Tlam
4,004,521 A * 1/1977 Andrejkovics ..... 102/267
4,440,085 A 4/1984 Rossmann et al.
4,942,816 A * 7/1990 Bankel et al. ..... 102/235
4,995,317 A 2/1991 Bankel et al.
6,564,716 B1 * 5/2003 Steele et al. ..... 102/239

FOREIGN PATENT DOCUMENTS

DE 25 39 750 A1 3/1977
EP 0 360 187 B1 4/1995

* cited by examiner

*Primary Examiner*—Stephen M Johnson
(74) *Attorney, Agent, or Firm*—Scully, Scott, Murphy & Presser, P.C.

(57) ABSTRACT

A safety and arming device (10) for a spinning projectile fuze, which has a fuze housing (12), which is in the form of a pot, and a bearing body (14) with a booster charge (16). A spherical rotor (42) with a detonator (44) is mounted between the fuze housing (12) and the bearing body (14). A radial groove (22) is formed in the fuze housing (12), and an annular groove (46) is formed in the rotor (42). A holding ring (28) is forced against the annular groove (46), which is axially offset with respect to the radial groove (22), when the safety and arming device (10) is in the safe position. The holding ring (28) is designed with a separating slot (30) and a further, shorter slot (32). The separating slot (30) and the further slot (32) extend at the same distance apart in the circumferential direction of the holding ring (28) and define annular segment jaws (40). The spring device (48) has a pair of cup springs (58), which jointly form a horizontal V-shaped spring profile.

2 Claims, 1 Drawing Sheet

SAFETY AND ARMING DEVICE FOR A SPINNING PROJECTILE FUZE

BACKGROUND OF THE INVENTION

1. Field of the Invention

The invention relates to a safety and arming device for a spinning projectile fuze, including a fuze housing in the shape of a pot and having a bearing body, which contains a booster charge. A spherical rotor is mounted between the bearing body and booster charge and has a detonator arranged therein.

2. Discussion of the Prior Art

A safety and arming device of this type is known from EP 0 360 187 B1. In this known safety and arming device, the holding ring is formed with a wedge-shaped groove profile, which has supporting flaps, which point radially inwards, and have recesses between them. The supporting flaps and the recesses have base area dimensions of approximately the same size. This affects the spinning behavior of the holding ring, that is to say its behavior in terms of spreading apart when subjected to centrifugal forces. The spring device of this known safety and arming device is formed by a conical spiral compression spring. The spring behavior which is initiated by the firing acceleration of a corresponding spinning projectile is less than ideal in the case of this spring device in the form of a conical spiral compression spring.

SUMMARY OF THE INVENTION

Against the background of knowledge of these characteristics, the invention is based on the object of providing a safety and arming device of the type mentioned initially, in which both the spring characteristics of the spring device during the firing acceleration and the spreading-open characteristics of the holding ring on arming of the safety and arming device are further optimized.

In the case of a safety and arming device of the type mentioned initially, this object is achieved according to the invention by the features as detailed hereinbelow. Preferred refinements and developments of the safety and arming device according to the invention are further elucidated and set forth in the dependent claims.

Since, in the case of the safety and arming device according to the invention, the holding ring is designed to have at least one further narrow slot in addition to its separating slot, which further narrow slot extends from the inner edge of the holding ring to the vicinity of its outer edge, with the separating slot and the at least one further slot being provided at an equal distance from one another in the circumferential direction of the holding ring, this results in annular segment jaws with a comparatively large area, and corresponding masses. These relatively large masses of the annular segment jaws are associated with correspondingly large spin-dependent centrifugal forces, so that the holding ring is reliably spread open into the circumferential radial groove formed in the fuze housing in response to an acceleration-dependent mechanical load on the spring device.

Since, in the case of the safety and arming device according to the invention, the spring device has a pair of cup springs which together form a horizontal V-shaped spring profile, this results in matching spring characteristics, so that the spring device is reliably compressed only in response to the correct firing acceleration to such an extent that the holding ring comes to rest axially on the same plane as the circumferential radial groove in the fuze housing, so that the holding ring is spread open into the circumferential radial groove by the spin in this position.

In the case of the safety and arming device according to the invention, it has been found to be expedient for the holding ring to have a single further narrow slot, which is diametrically opposite the separating slot, such that the holding ring has two diametrically opposite annular segment jaws. The base areas of these two diametrically opposite annular segment jaws effectively correspond to the base area of the holding ring, that is to say the mass of the two annular segment jaws is a maximum, and this has a correspondingly positive effect on the spin-dependent centrifugal force.

The two-cup springs are preferably arranged such that the tip of the V-shaped spring profile points radially inwards. This has a positive effect on the guidance characteristics for the holding ring as the spin spreads open into the circumferential radial groove in the fuze housing.

BRIEF DESCRIPTION OF THE DRAWINGS

One exemplary embodiment of the safety and arming device according to the invention for a spinning projectile fuze is illustrated in the drawing, and is described in the following details.

In the drawings.

DETAILED DESCRIPTION OF THE INVENTION

Figure 1:
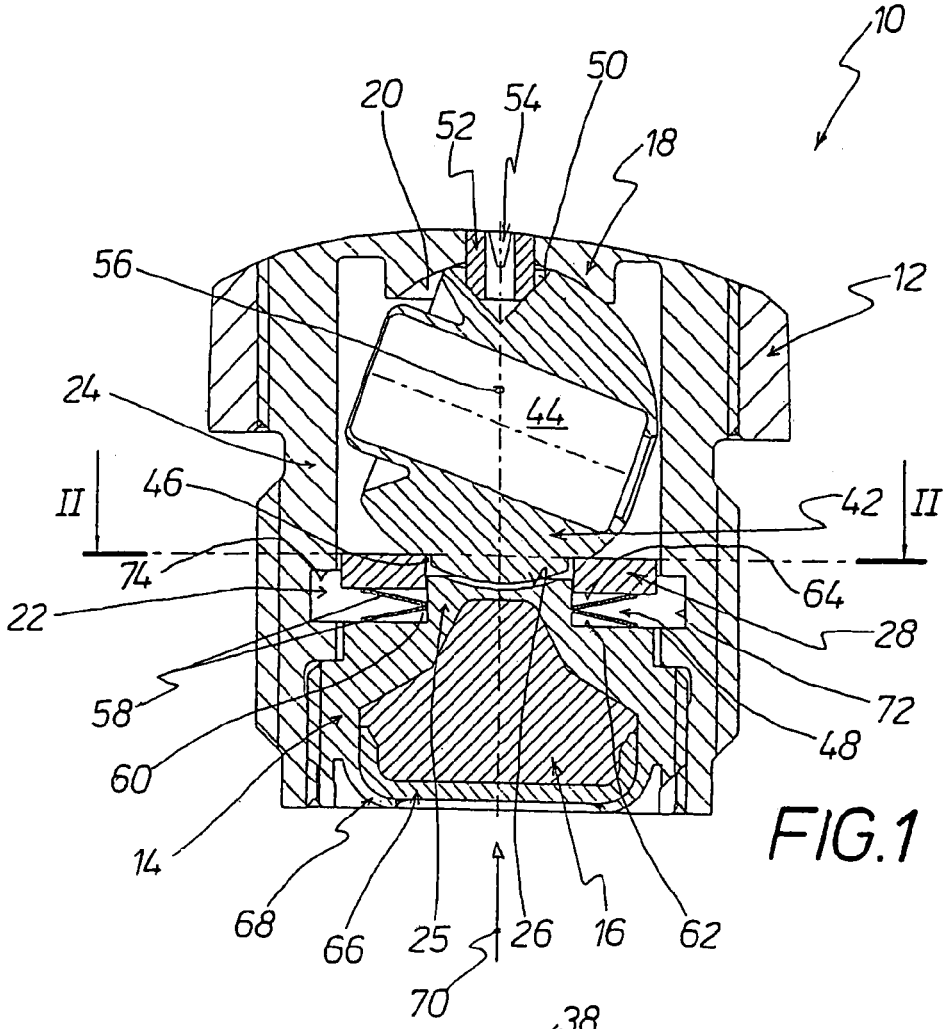
FIG. 1 shows a longitudinal section through the safety and arming device.

FIG. 1 shows a longitudinal section of one embodiment of the safety and arming device 10 for a spinning projectile fuze, which is not illustrated. The safety and arming device 10 has a fuze housing 12, which is in the form of a pot, and a bearing body 14 in which a booster charge 16 is provided.

The fuze housing 12, which is in the form of a pot, has a base 18 with a spherical bearing surface 20 and, at an axial distance from it, a circumferential radial groove 22, which is formed in the cylindrical casing 24 of the fuze housing 12, which is in the form of a pot.

Figure 2:
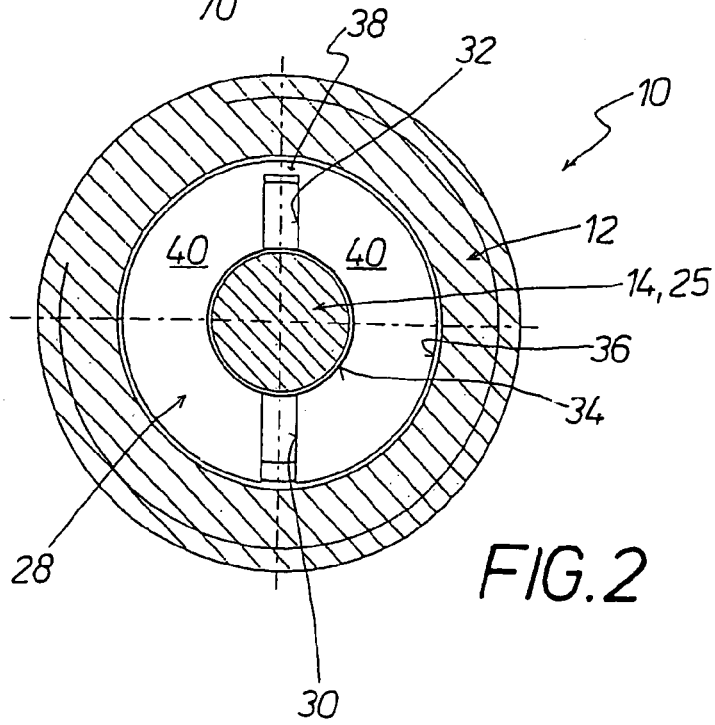
FIG. 2 shows a cross section through the safety and arming device along the section line II-II in FIG. 1.

On the inside, the bearing body 14 has a cylindrical attachment 25, whose end face facing the base 18 of the fuze housing 12 which is in the form of a pot has a spherical bearing surface 26. The cylindrical attachment 25 on the bearing body 14 is used for axially moving guidance of a holding ring 28, which has a radially oriented separating slot 30 and a further narrow slot 32—as illustrated in FIG. 2. The separating slot 30 extends between the inner edge 34 and the outer edge 36. The further slot 32, which is diametrically opposite the separating slot 30, extends from the inner edge 34 to the vicinity of the outer edge 36 of the holding ring, so that a web 38 remains between the further slot 32 and the outer edge 36 of the holding ring 28, and connects the two annular segment jaws 40 of the holding ring 28 to one another.

A spherical rotor 42, in which a detonator 44 is provided, is arranged between the base 18 of the fuze housing 12, which is in the form of a pot, and the cylindrical attachment 25 on the bearing body 14. The spherical rotor 42 has a circumferential annular groove 46, against which the holding ring 28 is forced by means of a spring device 48 in the safe position as illustrated in FIG. 1, in order to prevent any movement of the spherical rotor 42.

A conical recess 50 is formed diametrically opposite the circumferential annular groove 46 in the spherical rotor 42. A safety sleeve 52 engages in this conical recess 50 in the safe position. A firing needle 54 is provided in the safety sleeve 52. The firing needle 54 is used to strike the detonator 44 after firing the spinning projectile, which is not shown, when the detonator 44 is axially aligned with the firing needle 54 and the booster charge 16 by the acceleration and spin. In the safe position illustrated in FIG. 1, the detonator 44 is oriented at an oblique angle to the centre axis 56 of the safety and arming device 10, producing a geometric connection between the firing needle 54 and the booster charge 16.

The spring device 48 has a pair of cup springs 58 which together form a horizontal V-shaped spring profile, as can be seen in FIG. 1. The two-cup springs 58 are arranged in such a way that the tip 60 of the V-shaped spring profile points radially inwards. The tip 60 is thus adjacent to the cylindrical attachment 25 on the bearing body 14. The outer edge of one cup spring rests on an annular contact surface 62 on the bearing body 14, from which the cylindrical attachment 25 projects centrally. The outer edge of the other cup spring 58 rests on the annular lower face 64 of the holding ring 28. In the safe position, the spring device 48 keeps the spherical rotor 42 a short distance away from the spherical bearing surface 26 of the bearing body 14, and presses it against the spherical bearing surface 20 of the base 18 of the fuze housing 20, which is in the form of a pot.

The booster charge 16 is fixed in the bearing body 14 by means of a cover element 66. The cover element 66 is connected to the bearing body 14 by means of a flanged edge 68. The flanged edge 68 is an integral component of the bearing body 14.

The safety and arming device 10 operates as follows:

The safety and arming device 10 of a spinning fuze, which is not illustrated, reacts to firing acceleration acting in the direction of the arrow 70 (see FIG. 1) by axial movement of the holding ring 28 against the spring force of the spring device 48. During this process, the holding ring 28 moves to its outermost axial movement position, in which the spring device 48 cannot be compressed any further, but is "blocked". In this position, the holding ring 28 is aligned with the circumferential radial groove 22 in the fuze housing 12, which is in the form of a pot. After the spin builds up on the corresponding projectile in the weapon barrel, the holding ring 28 can thus expand into the circumferential radial groove 22.

The holding ring 28 is composed of a suitable metal or a suitable metal alloy, in order to ensure that it rests on the base 72 of the circumferential radial groove 22 as a result of the centrifugal forces acting on its annular segment jaws 40. During this process, the web 38, which connects the annular segment jaws 40 of the holding ring 28, is plastically, that is to say permanently, deformed.

The spherical rotor 42, which has now been released from the holding ring 28, is aligned in the armed position by virtue of its centre of gravity position, with the safety sleeve 52 being moved out of the conical recess 50, by means of said conical recess 50 in the spherical rotor 42. The spherical rotor 42 is locked by means that are not illustrated in the said armed position.

After completion of the acceleration phase of the projectile, the spring device 48 ensures that the holding ring 28 makes contact with the annular end surface 74 of the circumferential radial groove 22 in the fuze housing 12, which is in the form of a pot.

When a firing criterion is satisfied, then the firing needle 54 strikes the detonator 44 (which is in the armed position) in a known manner, and its firing energy then initiates the booster charge 16.

A further advantage of the spinning projectile fuze resides in that, even during a drop test of the ammunition, which is equipped with the aforementioned fuze, the spinning projectile fuze remains secure at a drop from a height of 12 meters. The plate spring device 48 ensures that the holding ring 28 retains the rotor 42 accordingly remains in its secured or safe position.

Moreover, the holding ring 28 possesses a single deformation zone in the region of the web. At the pick-up in the spin of the projectile, the holding ring is located in the weapon barrel in the region of the radial groove 22 due to the firing acceleration, and as a result thereof can expand radially. Consequently, singly and alone is the web 38 deformed. The holding ring 28 expands hereby in a side-shape, and in about a three-point form lies against he surrounding bottom 72 of the radial groove 22.

Accordingly, there is present a surprisingly simple configuration of the holding ring 28. The undisrupted functioning is afforded due to the simple assembly of the safely arrangement, especially the simple components; namely the holding ring and the plate spring device.

LIST OF REFERENCE SYMBOLS

10 Safety and arming device
12 Fuze housing in the form of a pot (of 10)
14 Bearing body (of 10 for 16)
16 Booster charge (in 14)
18 Base (of 12)
20 Spherical bearing surface (of 18)
22 Circumferential radial groove (in 24)
24 Cylindrical casing (of 12)
25 Cylindrical attachment (of 14)
26 Spherical bearing surface (of 14)
28 Holding ring (of 10)
30 Separating slot (in 28)
32 Further, shorter slot (28)
34 Inner edge (of 28)
36 Outer edge (of 28)
38 Web (of 28 between 40)
40 Annular segment jaws (of 28)
42 Spherical rotor (of 10)
44 Detonator (in 42)
46 Circumferential annular groove (in 42 for 28)
48 Spring device (of 10 for 28)
50 Conical recess (in 42 for 52 and 54)
52 Safety sleeve (for 42)
54 Firing needle (in 52 for 44)
56 Centre axis (of 10)
58 Cup springs (of 48)
60 Tip (of 48)
62 Annular contact surface (of 14)
64 Annular lower face (of 28)
66 Cover element (for 16)
68 Flanged edge (of 14 for 66)
70 Arrow/firing acceleration (of 10)
72 Base (of 22)
74 End surface (of 22)

What is claimed is:

1. Safety and arming device for a spinning projectile fuze, having a fuze housing (12) which is in the form of a pot and having a bearing body (14) which contains a booster charge (16), a spherical rotor (42) being mounted between said bearing body (14) and said fuze housing (12), a detonator (44) being provided in said spherical rotor, a circumferential radial groove (22) being formed in the fuze housing (12) and a circumferential annular groove (46) being formed in the rotor (42), said annular groove (46) being provided on a plane which is axially offset with respect to the circumferential radial groove (22) when the safety and arming device (10) is in a safe position, and in which there is arranged a holding ring (28), which is outwardly spreadable and is split by a separating slot (30), a spring device (48) being provided between the holding ring (28) and the bearing body (14) for forcing the holding ring (28) against an annular contact surface of the annular groove (46) when the safety and arming device (10) is in the safe position, the holding ring (28) being formed by a further slot (32) and a web (38) facing said further slot (32), said further slot being shorter than said separating slot (30), said further slot (32) extending from an inner edge (34) of the holding ring (28) into proximity to an outer edge (36) thereof, the separating slot (30) and the further slot (32) extending at the same uniform spacing in the circumferential direction of the holding ring (28) and which spacing is defined by two annular segment jaws (40), and wherein the spring device (48) includes a pair of cup-shaped plate springs (58) which jointly form a horizontal V-shaped spring profile.

2. Safety and arming device according to claim 1, wherein the two cup-shaped plate springs (58) are arranged such that the apex (60) of the V-shaped spring profile is directed radially inwardly.

* * * * *